US007096859B2

(12) United States Patent
Hamisch et al.

(10) Patent No.: US 7,096,859 B2
(45) Date of Patent: Aug. 29, 2006

(54) CARBURETOR ARRANGEMENT OF A PORTABLE HANDHELD WORK APPARATUS

(75) Inventors: Claus-Peter Hamisch, Stuttgart (DE); Andreas Schulz, Stuttgart (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 15 days.

(21) Appl. No.: 10/948,227

(22) Filed: Sep. 24, 2004

(65) Prior Publication Data

US 2005/0066944 A1 Mar. 31, 2005

(30) Foreign Application Priority Data

Sep. 29, 2003 (DE) ..... 103 45 144

(51) Int. Cl.
*F02M 31/06* (2006.01)

(52) U.S. Cl. ..... 123/543; 123/41.7; 261/144

(58) Field of Classification Search ..... None
See application file for complete search history.

(56) References Cited

U.S. PATENT DOCUMENTS

2003/0037773 A1* 2/2003 Zimmermann et al. ..... 123/556
2003/0183208 A1* 10/2003 Nara et al. ..... 123/556

* cited by examiner

*Primary Examiner*—Andrew M. Dolinar
(74) *Attorney, Agent, or Firm*—Walter Ottesen

(57) ABSTRACT

A carburetor arrangement of a portable handheld work apparatus includes a carburetor (1) which is fixed to a motor housing (4) of the work apparatus by elastic support elements (2, 3). A warm air channel (5) is provided for conducting warmed air (6) to the carburetor (1). At least one part of the warm air channel (5) runs through at least one support element (2, 3).

15 Claims, 2 Drawing Sheets

CARBURETOR ARRANGEMENT OF A PORTABLE HANDHELD WORK APPARATUS

CROSS REFERENCE TO RELATED APPLICATION

This application claims priority of German patent application no. 103 45 144.7, filed Sep. 29, 2003, the entire content of which is incorporated herein by reference.

BACKGROUND OF THE INVENTION

In portable motor-driven work apparatus such as chain saws, brushcutters, blowers/suction apparatus or the like, carburetor arrangements are known wherein a carburetor is fixed by means of elastic support elements to a motor housing of the work apparatus. The carburetor and an air filter case attached thereto can vibrate relative to the motor housing. A compensation of heat-caused dimensional fluctuations is also possible.

At low ambient temperatures and corresponding air humidity, an icing of the carburetor can occur during operation of the work apparatus. The air humidity in the intake air flow can lead to the formation of ice within the carburetor within the region of the fuel nozzles. A rough running of the engine or a standstill of the engine are the consequence. To prevent carburetor icing, the arrangement of a warm air channel is known by means of which warmed air is supplied to the carburetor. The cooling air flow of the engine functions as a heat source and this cool air flow has an adequately high temperature after passing over especially the cylinder. A targeted guidance of a warm air flow from the engine to the carburetor is difficult to provide because of the elastic support of the carburetor and the relative movability of the carburetor to the engine housing or to the engine itself because of this elastic support.

SUMMARY OF THE INVENTION

It is an object of the invention to provide a reliable and constructively simple hot air supply to a carburetor.

The carburetor arrangement of the invention is for a portable handheld work apparatus having a motor housing. The carburetor arrangement includes: a carburetor; a plurality of elastic support elements for mounting the carburetor on the motor housing; a warm air channel for conducting heated air to the carburetor; and, at least one of the elastic support elements being configured to form part of the warm air channel.

In the above, at least one portion of the hot air channel runs through at least one elastic support element. The elastic support element therefore has a double function as an elastic support of the carburetor and as an air-conducting element for the carburetor pre-warming. The elastic material characteristics of the support element can become effective also with respect to a sealing action. The wanted elastic suspension of the carburetor to compensate for engine vibrations and temperature-caused expansion differences can, at the same time, be achieved with a flow-tight, precisely defined conduit of the hot-air flow to the carburetor. A reliable pre-warming of the carburetor and, more specifically, an avoidance of carburetor icing, is obtainable with little constructive complexity.

The warm air channel advantageously includes an inlet end and an outlet end. The inlet end and the outlet end extend through respective support elements separate from each other. The carburetor is reliably supported by at least two spatially separated support elements. The throughflow of both support elements in their function as inlet and outlet u&d leads to a defined flow guidance of the warm air. The warm air can be supplied to the carburetor without unwanted losses. There results a reliable de-icing action even with small quantities of warm air.

In an advantageous further embodiment, the carburetor is thermally-conductively connected to a hot plate subjected to the warmed air in the warm air channel. The hot plate acts as a heat exchanger and takes up heat from the air flow in the warm air channel. With a suitable shape, the hot plate has a high thermal take-up capability with low aerodynamic resistance. It is practical when one channel wall is formed by the hot plate to simplify construction and to generate a simple flow cross section. A direct impingement of the carburetor with the warm air flow is avoided.

In a practical alternative, the warm air channel is formed by a warm air case between the inlet end and the outlet end. The warm air case at least partially surrounds the carburetor from the outside. Heat is supplied to the carburetor from the outside. The carburetor is uniformly warmed as a unit. Cold ambient air can be drawn into the intake channel of the carburetor independently of the warm air flow. The higher density of the cold air leads to a high engine power. The warming of the carburetor on the outside reliably prevents a formation of ice on the inside thereof.

In an advantageous embodiment, an air filter case is fixed by means of a case wall at the input end of the carburetor. The warm air channel runs on the carburetor side of the case wall. The case wall forms a partition wall between the intake air flow, which runs through the air filter, and the warm air flow provided for avoiding icing. The partition wall prevents the warm air flow from becoming mixed with the cold intake air. Power reduction because of intake air which is too warm is avoided. In a constructively simple embodiment, the case wall forms a portion of the warm air case.

In an advantageous embodiment, a portion of the warm air channel is configured as a tube stub. The bearing element is configured especially in the form of an elastic ring and engages around the tube support from the outside. The tube support can, for example, be formed on the warm air case as one piece. A simple assembly is made possible in that the tube stub is inserted into the elastic support element. A length compensation can take place with good sealing action with a corresponding slide seat between support element and tube stub.

In a further practical embodiment, a portion of the warm air channel is defined by the support element itself, especially, in the form of an elastic tube piece. The tube piece is adequately soft in all spatial directions. Greater relative movements can also easily be compensated. The tube piece is held form-tight in a wall of the warm air case to simplify the assembly and for a reliable positioning.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
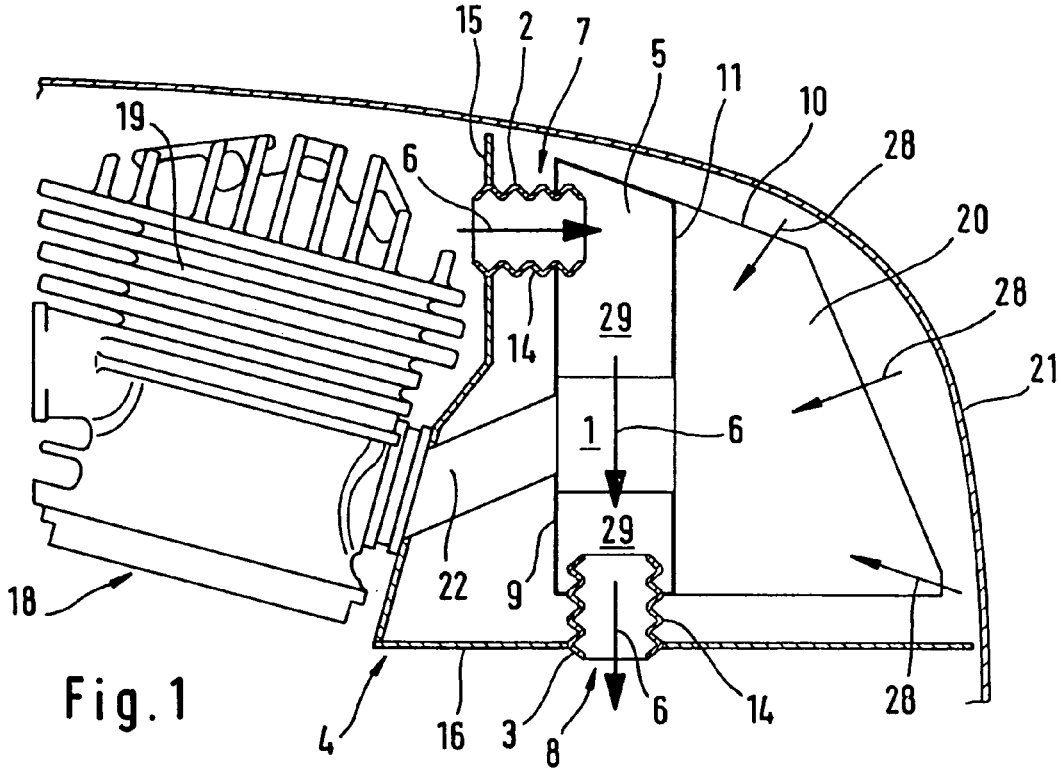
FIG. 1 is a schematic longitudinal section view which shows the region of the carburetor and the cylinder of a portable handheld work apparatus with two elastic support elements forming respective parts of the warm air channel.

FIG. 1 shows a portable handheld work apparatus in the form of a chain saw by way of example in the region of its internal combustion engine 18 which is provided for driving the work apparatus. The engine 18 includes a cylinder 19 to which a carburetor 1 is connected via an intake channel 22. The engine 18 is not shown in greater detail and is rigidly supported in a motor housing 4.

The motor housing 4 includes a back wall 15 as well as a base wall 16. The back wall 15 lies between the cylinder 19 and the carburetor 1. The carburetor is mounted by means of an elastic support element 2 in the region of the back wall 15 and is supported by an elastic support element 3 on the base wall 16. A further elastic support of the carburetor 1 is provided by the elastically configured intake channel 22.

An air filter case 10 is provided at the input end or intake end of the carburetor 1. The air filter case 10 has a case wall 11 by means of which the case 10 is attached to the carburetor at the input end facing away from the cylinder. An air filter 20 is disposed in the air filter case 10. During operation of the engine 18, ambient air is drawn by suction in the direction of arrows 28 through the air filter case 10 and air filter 20 and the carburetor 1 and from there, through the intake channel 22 into the cylinder 19. A cover 21 is separate from the motor housing 4 and covers the arrangement shown in the region of the cylinder 19, the carburetor 1 and the air filter case 10.

A warm air channel 5 is provided by means of which a warm air flow (indicated by arrows 6) can be conducted from the region of the cylinder 19 to the carburetor 1. In the embodiment shown, the warm air channel 5 includes a middle part 29 as well as an inlet end 7 and an outlet end 8. The warm air flow 6 travels from the cylinder 19 through the inlet end 7 into the center part 29 and, from there, through the outlet end 8 to the ambient. The warm air flow 6 flows over the carburetor 1 on the outer side thereof. The inlet end 7 passes through the back wall 15 and the outlet end 8 passes through the base wall 16 of the motor housing 4. In the embodiment shown, the center part 29 is configured as a warm air case 9 which at least partially encloses the carburetor 1 from the outside. In the embodiment shown, the case wall 11 of the air filter case 10 forms a part of the warm air case 9 and the warm air channel 5 runs on the side facing toward the cylinder 19, more specifically, the carburetor side of the case wall 11. The carburetor 1, the warm air case 9 and the air filter case 10 form approximately a rigid unit which is supported elastically on the motor housing 4 by means of the elastic support elements (2, 3) as well as the elastically configured intake channel 22.

The warm air channel 5 runs in the region of the inlet end 7 through the elastic support element 2 and, in the region of the outlet end 8, through the elastic support element 3. An arrangement can also be practical wherein, for example, only the inlet end 7 runs through a corresponding support element (2, 3). A free jet can be practical in lieu of the flow guidance by means of the warm air case 9. The support elements (2, 3) can also be connected directly to the carburetor 1.

In the embodiment shown, the inlet end 7 and the outlet end 8 of the warm air channel 5 are each configured as an elastic tube piece 14. One tube piece 14 is guided through the rear wall 15 and the other tube piece is guided through base wall 16 of the motor housing 4. The elastic tube pieces 14 form respective support elements (2, 3). The tube pieces 14 are held form-tightly in corresponding ones of the walls of the warm air case 9.

Figure 2:
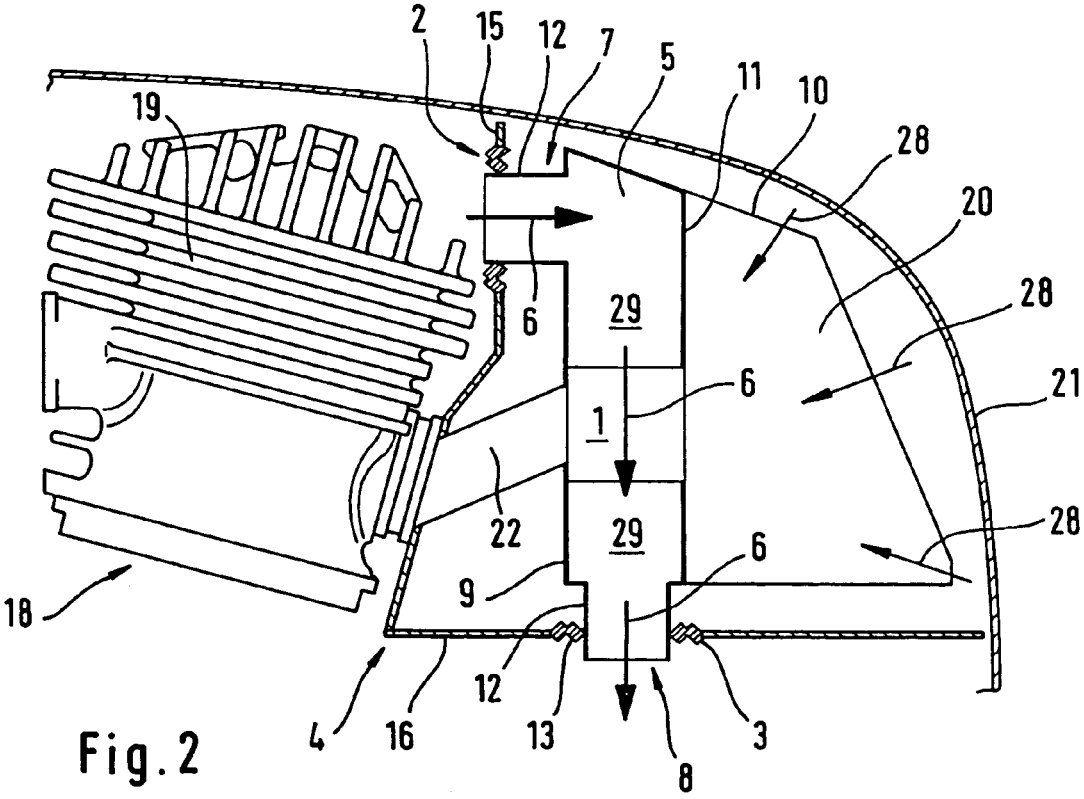
FIG. 2 shows an alternate embodiment of the invention wherein the inlet and outlet of the warm air channel are each configured as tube stubs; and, FIG. 3 is a schematic block representation and shows a carburetor having a hot plate subjected to the warm air flow.

FIG. 2 shows an alternate embodiment of the arrangement of FIG. 1. Here, the inlet end 7 and the outlet end 8 of the warm air channel 5 are each configured as tube stubs 12 which are formed on the warm air case 9 as one piece. The tube stubs 12 run through corresponding ones of the elastic support elements (2, 3). In the embodiment shown, the support elements (2, 3) are configured as respective elastic rings 13. In lieu of the elastic ring 13, a bellows or the like can be practical.

The inlet end 7 and the outlet end 8 can be configured as a tube stub 12 with the elastic ring 13 or as an elastic tube piece 14 as shown in FIG. 1.

Figure 3:
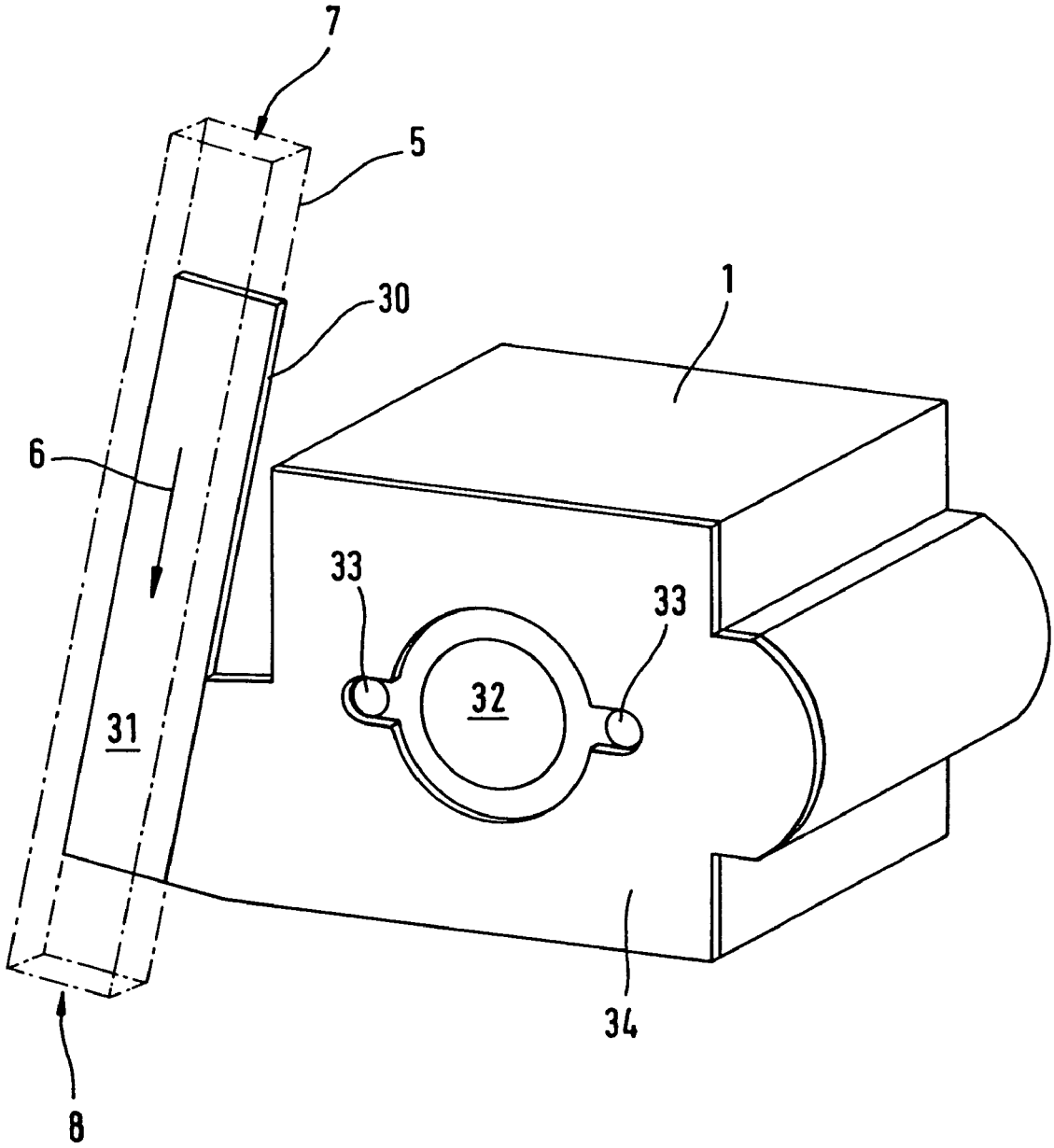

FIG. 3 shows a further embodiment with a carburetor 1 which has an intake channel 32 for supplying the engine 18 (FIG. 1) with an air/fuel mixture. Through bores 33 are provided at each end of the intake channel 32. In the assembled state of the carburetor 1, assembly pins (not shown) engage through the through bores 33 for fixing the carburetor 1.

A hot plate 30 is disposed in a component region of the warm air channel 5 between an inlet end 7 and an outlet end 8. The hot plate 30 is subjected to the warm air flow 6. The hot plate 30 forms a channel wall 31 of the warm air channel 5. An embodiment can be practical wherein the hot plate 30 projects into the warm air channel 5 so that warm air 6 flows about the same on all sides. In lieu of the planar configuration of the hot plate 30 shown, a tube-shaped, ribbed or other suitable configuration for increasing the heat transmitting surface can be practical.

The hot plate 30 is configured as one piece with a flange sheet metal 34. The flange sheet metal 34 is in surface contact with the end of the carburetor 1. The flange sheet metal 34 includes a corresponding cutout in the region of the through bores 33 and the intake channel 32. In the assembled state, the flange sheet metal 34 is clamped between the carburetor 1 and a corresponding housing wall whereby a heat-conducting connection results between the hot plate 30 and the carburetor 1.

The hot plate 30 and the flange sheet metal 34 are preferably manufactured from a material having a high heat conductivity such as aluminum.

It is understood that the foregoing description is that of the preferred embodiments of the invention and that various changes and modifications may be made thereto without departing from the spirit and scope of the invention as defined in the appended claims.

What is claimed is:

1. A carburetor arrangement of a portable handheld work apparatus having a motor housing, the carburetor arrangement comprising:

a carburetor;

a plurality of elastic support elements for mounting said carburetor on said motor housing;

a warm air channel for conducting heated air to said carburetor;

first and second tube stubs forming part of said warm air channel; and, first and second ones of said elastic support elements engaging and grasping said first and second tube stubs, respectively, about the outside thereof.

2. The carburetor arrangement of claim 1, wherein said first and second elastic support elements are configured to be in the form of elastic annular elements.

3. The carburetor arrangement of claim 1, wherein said first elastic support element and said first tube stub conjointly form a first composite unit with said first tube stub also being elastic and said first composite unit being part of said warm air channel; and, said second elastic support element and said second tube stub conjointly form a second composite unit with said second tube stub also being elastic and said second composite unit being part of said warm air channel.

4. The carburetor arrangement of claim 3, wherein said warm air channel is formed as a warm air case disposed between said first and second composite units; and, said first and second composite units are held form-tight in a wall of said warm air case.

5. A carburetor arrangement of a portable handheld work apparatus having a motor housing, the carburetor arrangement comprising:

a carburetor;

a plurality of elastic support elements for mounting said carburetor on said motor housing;

a warm air channel for conducting heated air to said carburetor;

at least a first tube stub forming part of said warm air channel; and, at least one of said elastic support elements engaging and grasping said tube stub about the outside thereof.

6. The carburetor arrangement of claim 5, wherein said elastic support element is configured to be in the form of an elastic annular element.

7. The carburetor arrangement of claim 5, wherein said elastic support element and said tube stub conjointly form a composite unit with said tube stub also being elastic and said composite unit being part of said warm air channel.

8. The carburetor arrangement of claim 7, wherein said warm air channel is formed as a warm air case; and, said composite unit is held form-tight in a wall of said warm air case.

9. The carburetor arrangement of claim 5, wherein said warm air channel has an inlet end and an outlet end; said one elastic support element is a first elastic support element defining said inlet end; a second one of said elastic support elements defines said outlet end; a second tube stub forms part of said warm air channel; and, said first and second ones of said elastic support elements engage and grasp said first and second tube stubs, respectively, about the outside thereof.

10. The carburetor arrangement of claim 5, further comprising a hot plate, manufactured from a high heat conductivity material, and heat-conductively connected to said carburetor; and, said hot plate being mounted so as to be subjected to the heated air in said warm air channel.

11. The carburetor arrangement of claim 10, wherein said high heat conductivity material is aluminum.

12. The carburetor arrangement of claim 10, wherein said hot plate defines a wall of said warm air channel.

13. The carburetor arrangement of claim 9, wherein said warm air channel is formed as a warm air case disposed between said first and second elastic support elements; and, said warm air case at least partially encloses said carburetor on the outside thereof.

14. The carburetor arrangement of claim 5, wherein said carburetor has an input end; said carburetor further comprises an air filter case having a case wall; said air filter case is mounted at said input end of said carburetor via said case wall thereof; and, said warm air channel extends between said case wall and said input end of said carburetor.

15. The carburetor arrangement of claim 14, wherein said case wall is part of said warm air channel.

* * * * *